US006112674A

United States Patent [19]

Stanford

[11] Patent Number: 6,112,674

[45] Date of Patent: Sep. 5, 2000

[54] PORTABLE FOLDING UTILITY TABLE WITH CENTER SUPPORT ASSEMBLY

[75] Inventor: Carl R. Stanford, Clinton, Utah

[73] Assignee: Lifetime Products, Inc., Clearfield, Utah

[21] Appl. No.: 09/228,326

[22] Filed: Jan. 11, 1999

Related U.S. Application Data

[63] Continuation-in-part of application No. 29/095,372, Oct. 21, 1998, Pat. No. Des. 414,626.

[51] Int. Cl.[7] ..... A47B 3/00

[52] U.S. Cl. ..... 108/132; 108/129

[58] Field of Search ..... 108/132, 131, 108/129, 130, 133, 115; 248/439

[56] References Cited

U.S. PATENT DOCUMENTS

| | | | |
|---|---|---|---|
| 236,197 | 1/1881 | Valley | 108/133 |
| 769,354 | 9/1904 | Nielsen . | |
| 1,063,642 | 6/1913 | Birdsall . | |
| 1,272,187 | 7/1918 | Basford . | |
| 1,296,336 | 3/1919 | Stine . | |
| 1,351,013 | 8/1920 | Stine . | |
| 1,514,418 | 11/1924 | Battenfeld . | |
| 1,594,572 | 8/1926 | Soltesz . | |

(List continued on next page.)

FOREIGN PATENT DOCUMENTS

| | | | |
|---|---|---|---|
| 650758 | 11/1964 | Belgium . | |
| 10007 | 5/1908 | United Kingdom | 108/131 |

*Primary Examiner*—Jose V. Chen
*Attorney, Agent, or Firm*—Madson & Metcalf

[57] ABSTRACT

A pivotable folding utility table includes a table top having a pair of support pedestals pivotally attached thereto. A first pivotal support brace, which includes a proximal end and a distal end, is attached at its proximal end to the first support pedestal. A second pivotal support brace, which includes a proximal end and a distal end, is attached at its proximal end to the second support pedestal. The distal ends of the first and second pivotal support braces are adapted to be pivotally attached to a retaining assembly, mounted in relation to the table top. The distal ends of each pivotal support brace are disposed contiguously in relation to each other when engaging the retaining assembly. Specifically, the retaining assembly includes a cross-brace member operably disposed through openings formed in the distal ends of the first and second pivotal support braces, thus providing a pivotal engagement in relation to the table top.

45 Claims, 4 Drawing Sheets

U.S. PATENT DOCUMENTS 1,659,840 2/1928 Smith .
1,757,260 5/1930 Silverman ..... 108/132
1,823,484 9/1931 Blumenthal .
1,888,117 11/1932 Fox ..... 108/133
2,109,869 3/1938 Ross .
2,257,550 9/1941 Gay .
2,278,810 4/1942 Virtue et al. ..... 108/131 X
2,411,658 11/1946 La Rue .
2,452,169 10/1948 Wells .
2,512,473 6/1950 Alch .
2,522,642 9/1950 Schmidt .
2,524,198 10/1950 La Rue .
2,548,682 4/1951 Price .
2,558,465 6/1951 Seymour .
2,568,622 9/1951 Hagan .
2,579,934 12/1951 Krasney .
2,583,247 1/1952 Aja et al. .
2,621,710 12/1952 Miller .
2,647,562 8/1953 Hoffar .
2,661,792 12/1953 Lysaght .
2,670,031 2/1954 Melges .
2,690,210 9/1954 Holick .
2,717,028 9/1955 Villemune .
2,717,631 9/1955 Howe .
2,722,971 11/1955 Gallagher et al. .
2,748,837 6/1956 Beller .
2,752,987 7/1956 Smithers .
2,766,812 10/1956 Schrader .
2,771,937 11/1956 Wilson .
2,780,506 2/1957 Howe .
2,788,059 4/1957 Mackintosh .
2,800,379 7/1957 Smithers .
2,805,708 9/1957 Bohn .
2,811,197 10/1957 Nimmo .
2,811,400 10/1957 James .
2,825,390 3/1958 Post .
2,837,141 6/1958 Shore .
2,849,053 8/1958 Beller et al. .
2,878,589 3/1959 Howe et al. .
2,936,820 5/1960 Blink et al. .
2,939,516 6/1960 Drew .
2,959,209 11/1960 Lakin .
2,978,754 4/1961 Wilson .
2,983,308 5/1961 Horowitz .
2,992,043 7/1961 Nelson .
3,025,120 3/1962 Howe .
3,027,209 3/1962 Nielsen .
3,030,728 4/1962 Wesman .
3,041,775 7/1962 Brown, Jr. et al. .
3,079,197 2/1963 Mugler .
3,080,193 3/1963 Nimmo .
3,093,924 6/1963 Pompa .
3,096,866 7/1963 Glass .
3,101,062 8/1963 Kanzelberger .
3,112,954 12/1963 Kanitz .
3,141,424 7/1964 Seymour .
3,144,236 8/1964 Clanin .
3,174,796 3/1965 Brown .
3,191,991 6/1965 Anderson et al. .
3,256,037 6/1966 Giambalvo .
3,259,426 7/1966 Shaw et al. .
3,267,886 8/1966 Glass .
3,273,936 9/1966 Deavers .
3,276,815 10/1966 Cardy .
3,337,262 8/1967 Katzfey et al. .
3,349,728 10/1967 Barecki et al. .
3,357,729 12/1967 Krueger ..... 108/130 X
3,410,232 11/1968 Krueger .
3,429,283 2/1969 Uhor .
3,545,738 12/1970 Stagg .
3,574,393 4/1971 Hughes .
3,580,632 5/1971 Seymour .
3,650,560 3/1972 Wohlk .
3,672,719 6/1972 Haukedahl .
3,692,358 9/1972 Sung .
3,731,971 5/1973 Sjogren .
3,762,626 10/1973 Dorsey .
3,765,719 10/1973 Silver .
3,788,696 1/1974 Loewen .
3,797,884 3/1974 Gutierrez .
3,857,343 12/1974 Greenburg .
3,885,829 5/1975 Haeger .
3,893,400 7/1975 Grant .
3,922,408 11/1975 Smith .
3,960,354 6/1976 Simikoski .
3,994,527 11/1976 Nikitits et al. .
4,040,658 8/1977 Mayol .
4,043,277 8/1977 Wallace .
4,047,754 9/1977 Cathey .
4,052,100 10/1977 Nikitits et al. .
4,060,275 11/1977 Hansen .
4,064,812 12/1977 Commanda .
4,064,815 12/1977 Baum .
4,070,057 1/1978 Jones .
4,072,231 2/1978 Helms .
4,111,482 9/1978 Jones .
4,131,311 12/1978 Nikitits et al. .
4,157,089 6/1979 Loughrey .
4,191,111 3/1980 Emmert .
4,249,773 2/1981 Giambalvo .
4,289,350 9/1981 Thomas et al. .
4,330,151 5/1982 Healey .
4,382,627 5/1983 Dean .
4,415,199 11/1983 Wright .
4,489,661 12/1984 Fitzgerald .
4,537,443 8/1985 Bray .
4,572,574 2/1986 Fishhaber et al. .
4,596,196 6/1986 Gunter et al. .
4,606,575 8/1986 Kodet .
4,648,652 3/1987 Van Kuren .
4,653,804 3/1987 Yoo et al. .
4,700,987 10/1987 Sraka et al. .
4,744,309 5/1988 Kiesel et al. .
4,762,321 8/1988 Chang .
4,817,902 4/1989 Mason .
4,826,244 5/1989 Choi .
4,864,941 9/1989 Goulter ..... 108/132
4,883,314 11/1989 Sakong .
4,903,686 2/1990 Jennings .
4,951,576 8/1990 Cobos et al. ..... 108/131
4,960,303 10/1990 York .
5,007,673 4/1991 Cheng .
5,014,628 5/1991 Roberts .
5,018,785 5/1991 Monson et al. .
5,029,938 7/1991 Song .
5,060,902 10/1991 Hartman .
5,109,778 5/1992 Berkowitz et al. .
5,149,575 9/1992 Soifer .
5,208,084 5/1993 Rutz .
5,240,307 8/1993 Jones et al. .
5,279,233 1/1994 Cox ..... 108/132 X
5,284,100 2/1994 Thorn .
5,314,231 5/1994 Otterbacher .
5,325,793 7/1994 Martin .
5,357,872 10/1994 Wilmore ..... 108/132 X
5,394,808 3/1995 Dutro et al. .
5,411,314 5/1995 Wallace .
5,440,857 8/1995 Shanok et al. .
5,638,761 6/1997 Berkowitz et al. ..... 108/132
5,732,637 3/1998 Raab ..... 108/129

PORTABLE FOLDING UTILITY TABLE WITH CENTER SUPPORT ASSEMBLY

RELATED U.S. APPLICATIONS

This application is a continuation-in-part of our patent application Ser. No. 29/095,372, filed Oct. 21, 1998 and entitled UTILITY TABLE, which is incorporated herein by reference and which has now issued as U.S. Pat. No. Des. 414,626, and our patent application Ser. No. 29/105,094, filed May 17, 1999 now U.S. Pat. No. Des. 419,332 and entitled UTILITY TABLE, which is also incorporated herein by reference.

BACKGROUND

1. The Field of the Invention

The present invention is related to a utility table, and more particularly, to a portable folding utility table having a single center support assembly.

2. Technical Background

Portable folding utility tables are indispensable for groups or organizations that have limited floor space usable for multiple purposes. For example, foldable utility tables can be placed in a pre-determined configuration to meet the space requirements of a school gymnasium, a church multi-purpose room, or a hotel conference meeting room. Afterward, the tables can be neatly stored away and the room used for a different purpose. Thus, portable folding utility tables allow a group or organization to maximize the efficiency and utility of a particular space.

Foldable utility tables can also provide an immediate temporary work space in a garage, tool shed, and the like. The portability and foldability of these utility tables allows a user to conveniently set up, take down, and store the table whenever and wherever the user chooses.

A major drawback with many portable folding utility tables of the prior art is their inherent size and bulkiness. Many such utility tables require two people to collapse and store the table after use. Moreover, some prior art portable folding utility tables are heavy enough to cause injury if dropped or mishandled. These unwieldy tables are usually made from hardwood, particle board, or similarly heavy materials. In an attempt to overcome this bulkiness problem, some prior art portable utility tables are formed of lighter-weight materials. However, many of these utility tables generally lack the sturdiness of the heavier-weight prior art utility tables.

Another disadvantage to many prior art utility tables is the means used for attaching the table legs or two or more support pedestals to the underside of the table. As will be appreciated, prior art table legs are typically attached to the table top using threaded screws or bolts that are drilled into the underside of the table top. This means of attachment may compromise the integrity of the table top thereby making it weaker at the point of attachment between the table legs and the table top. Other attachment mechanisms may include a form of bonding the support legs as support pedestals directly against the surface of the table top. Often, however, this means of attachment by bonding weakens the structural integrity of the table top. Thus, when the support legs fail, the table top material may pull away at the point of the bonded attachment making the table costly, if not impossible to repair.

In an attempt to overcome the foregoing disadvantages, prior art utility tables were developed by those skilled in the art that are equipped with complex or heavy-duty attachment mechanisms to secure the support legs or support pedestals to the table top. These types of attachment mechanisms, however, are normally heavier, more costly, more difficult to install, and typically require additional time to manufacture.

The previously stated disadvantages are compounded by the fact that prior art utility tables incorporate a separate and distinct attachment mechanism for attaching each support leg or pedestal to the table top. Most existing portable folding utility tables have two sets of legs or support pedestal supports, one at each end of the table. Each of these supports is typically attached to the underside of the table top at two places. Correspondingly, many of these tables have four separate points of attachment, each with a separate attachment mechanism. One particular problem with utility tables having separate and distinct attachment mechanisms is that they are generally susceptible to bowing in the center of the table under stress. This is especially true with larger banquet-style tables.

Yet another drawback with many prior art utility tables is that the hard materials used to maintain a sufficient rigidity and sturdiness of the table top often have sharp edges which may be uncomfortable for the user to lean against or rest their arms upon. Further, these materials are also susceptible to damage from the elements of nature.

From the foregoing, it will be appreciated that it would be an advancement in the art to provide a portable folding utility table that is durable enough to withstand the increased wear and tear that portable utility tables are subjected to over long periods of time and sturdy enough to support varying sized loads that will be place on the table, while at the same time being light-weight enough to be easily set up and taken down.

It would be another advancement in the art to provide a portable folding utility table having a leg or support pedestal attachment mechanism that doesn't involve a complex design, heavy-duty attachment hardware, or need to be screwed, bolted, or bonded to the under side of the table top. It would be a further advancement in the art to provide a portable folding utility table that minimizes the points of attachment to the table top and facilitates attachment mechanisms that interrelate with each other to support the table top above a surface.

Finally, it would be an advancement in the art to provide a portable folding utility table that provides a working surface that is comfortable to work at and that us capable of withstanding the elements of nature.

Such a portable folding utility table is disclosed and claimed herein.

BRIEF SUMMARY OF THE INVENTION

The present invention is directed to a novel portable folding utility table having a center support assembly. The utility table includes a table top supported by a pair of support pedestals. In one presently preferred embodiment, the table top includes a mounting surface and a working surface formed opposite the mounting surface. The working surface may be textured and may include an outer periphery, at least a portion of which is beveled to provide comfort to a user.

A first end of each support pedestal is preferably attached to the mounting surface of the table top. In one presently preferred embodiment, the support pedestals are pivotally attached to the mounting surface of the table top, to allow each support pedestal to be moved between a collapsed position and an extended position. A securing member may also be attached to the mounting surface for releasably securing a support pedestal in the collapsed position.

Additionally, the utility table may include a first pivoting support brace attached to the first support pedestal at a proximal end and to the mounting surface at a distal end thereof Similarly, a second pivoting support brace may be attached to the second support pedestal at a proximal end and to the mounting surface at a distal end thereof In one presently preferred embodiment, the distal ends of the first and second pivotal support braces are disposed contiguous to each other at a retention assembly attached to the mounting surface.

In one presently preferred embodiment of the present invention, the retention assembly may include a single cross-brace member disposed through openings formed at the distal ends ofthe pivotal support braces and secured to the mounting surface. The mounting surface may be configured such that the cross-brace member is disposed through openings disposed in opposing sides of the mounting surface of the table top and may further include a mount for receiving and retaining the cross-brace member therein. Thus, both support pedestals are preferably attached to the cross-brace member secured to the mounting surface, thereby reducing the number of attachment mechanisms and interrelating the support pedestals to increase structural support and efficiency of manufacture.

In another presently preferred embodiment, each support pedestal includes a first member pivotally engaging the mounting surface of the table top and a second member configured for telescoping engagement with the first member. This configuration permits the height of the support pedestal to be disposed between a lengthened position and a retracted position.

From the foregoing, it will be appreciated that the present invention provides a portable folding utility table that is durable enough to withstand increased wear and tear yet is light-weight for easy set up and take down. The present invention also provides a novel center support assembly that provides increased structural stability with efficient design such that to allow the interrelation of the support pedestals. The center support assembly is also cost effective to manufacture and doesn't compromise the integrity of the table top. Further, the present invention provides a utility table that is comfortable to work at. The foregoing and other advantages and features of the present invention will become more fully apparent by examination of the following description of the presently preferred embodiments and appended claims, taken in conjunction with the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
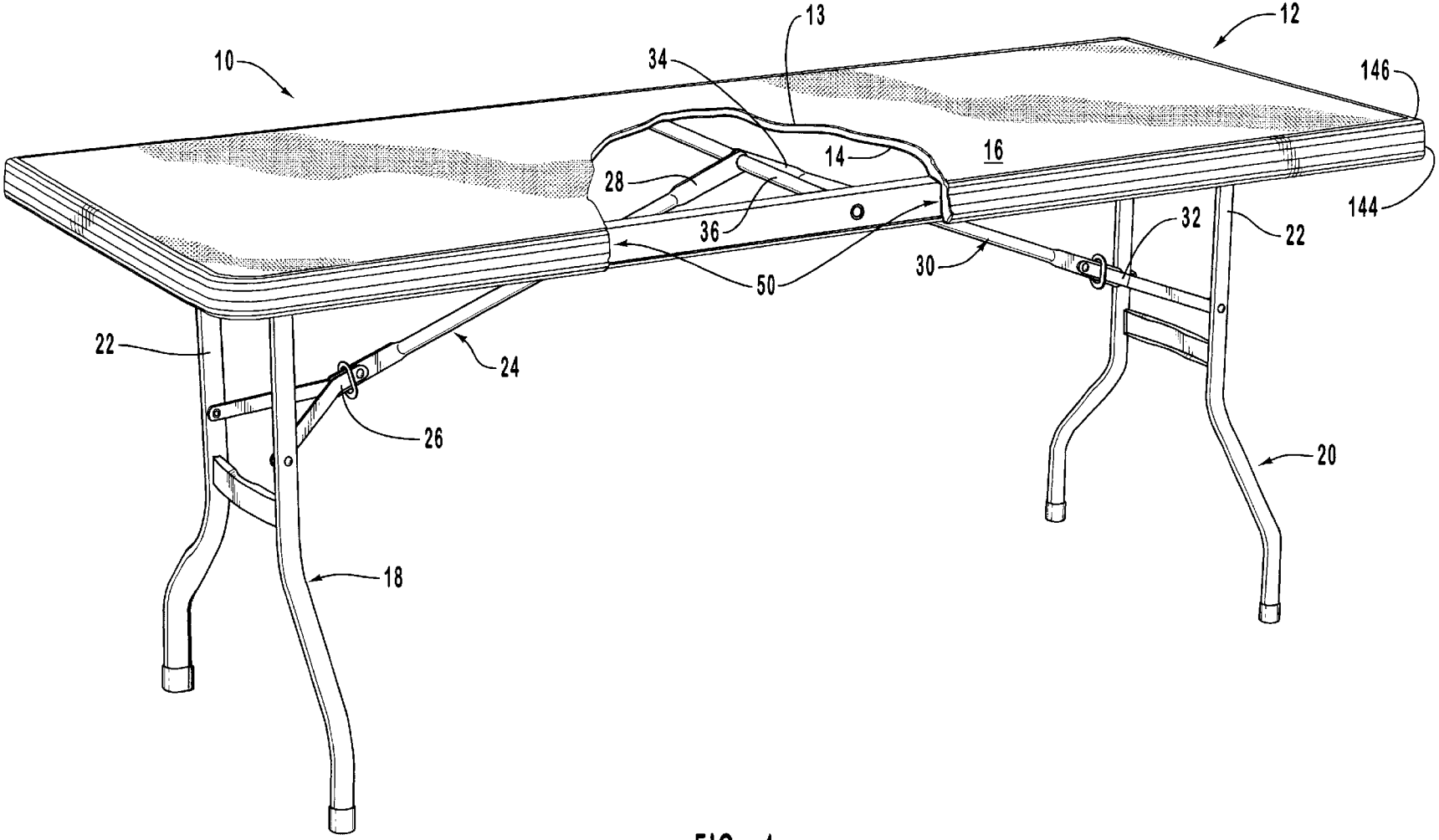
FIG. 1 is a perspective cut-away view of one presently preferred embodiment of a portable folding utility table with center support assembly.

Reference is now made to the figures wherein like parts are referred to by like numerals throughout. With particular reference to FIG. 1, a utility table according to the present invention is generally designated at 10. The utility table 10 preferably includes a table top 12 having a mounting surface 14 and a working surface 16 disposed opposite the mounting surface 14. In one presently preferred embodiment, the table top 12 is supported by a first support pedestal 18 and a second support pedestal 20. The first and second support pedestals 18, 20 may each comprise a first end 22 attached to the mounting surface 14 of the table top 12.

Figure 2:
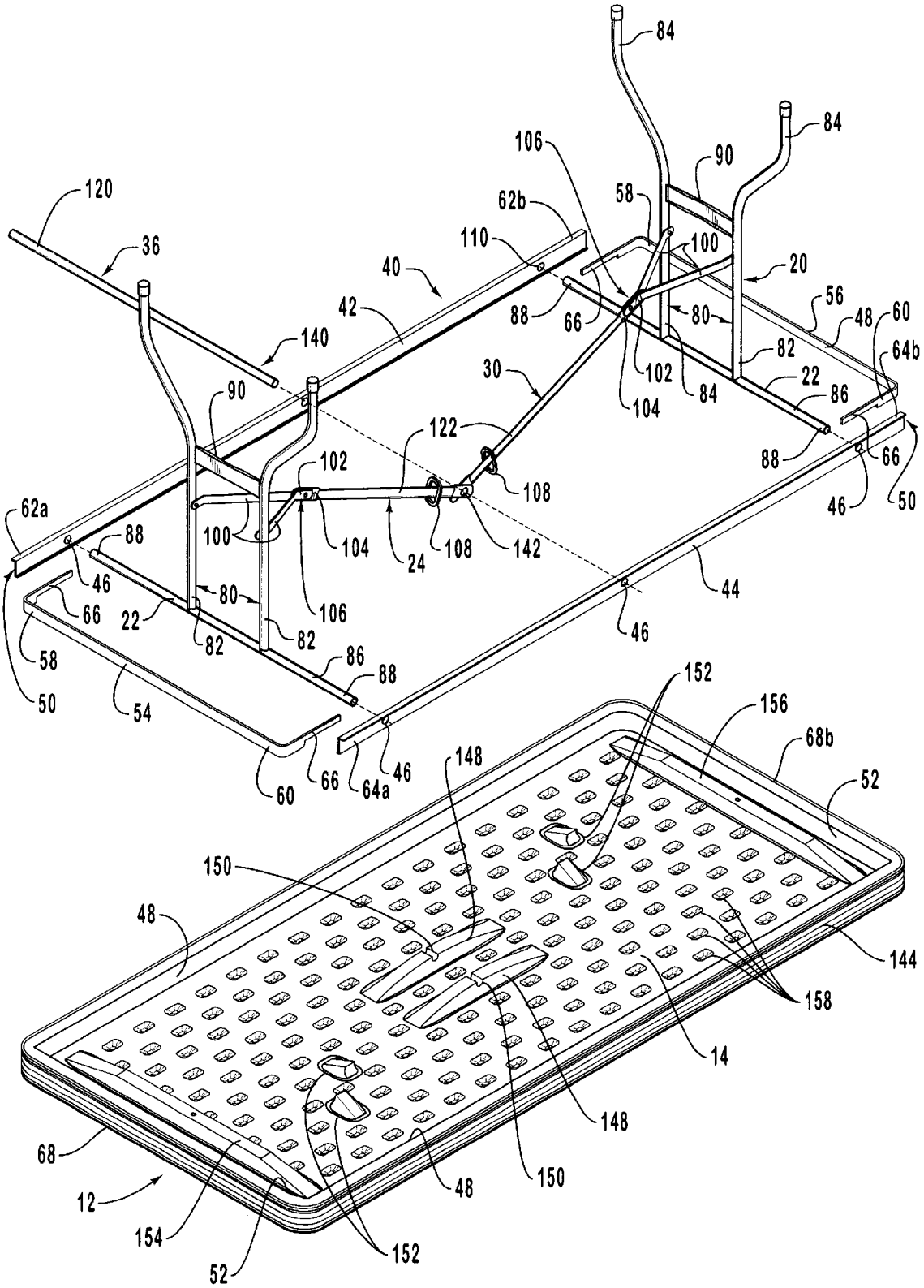
FIG. 2 is an exploded, perspective view of the embodiment of FIG. 1 illustrating various components of the present invention.

Referring now to FIGS. 1 and 2, the utility table 10 of the presently preferred embodiment includes a first pivotal support brace 24 having a proximal end 26 attached to the first support pedestal 18 and a distal end 28 attached to the mounting surface 14. Similarly, a second pivotal support brace 30 having a proximal end 32 attached to the second support pedestal 20 and a distal end 34 attached to the mounting surface 14. The distal end 28 of the first pivotal support brace 24 may be disposed contiguous the distal end 34 of the second pivotal support brace 30. The distal ends 28,34 are disposed in relation to a retaining assembly 36, which is attached to the mounting surface 14. In one preferred embodiment, the retaining assembly 36 comprise a cross member.

As shown in FIG. 2, the utility table 10 includes a frame 40. The frame 40 may comprise a first side rail 42 and an opposing second side rail 44. Preferably, the first side rail 42 is disposed substantially parallel the opposing second side rail 44, thereby providing a generally longitudinal alignment therebetween. The first and second side rails 42, 44 may be configured with a plurality of retaining apertures 46 to facilitate attachment of the support pedestals 18, 20 and the cross brace member 36 to the frame 40.

In one preferred embodiment, the mounting surface 14 of the table top 12, comprises opposing longitudinal interior side walls 48, and opposing orthogonal interior side walls 52 disposed along an interior periphery of the table top 12. The first and second side rails 42, 44 may be secured to respective opposing longitudinal side walls 48, thus adding rigidity and strength to the structural integrity of table top. In one presently preferred embodiment, the side rails 42, 44 are secured into the opposing longitudinal side walls 48 by screws. It will be appreciated by those skilled in the art that the side rails 42, 44 may be secured to the opposing longitudinal side walls 48 of the mounting surface 14 in a variety of other ways readily known in the art, such as, for example, screw, bolts, rivets, and the like.

The cross-section of the sides rails 42,44 are preferably configured having an S-shape. The side rails 42, 44 are preferably attached to the respective longitudinal side walls 48 so as to form respective channels 50 along the side rails 42, 44 between the side rails 42, 44 and the longitudinal side walls 48 (see FIGS. 1 and 2). In this configuration, the first end 22 of the support pedestals 18, 20 may be positioned within opposing respective retaining apertures 46 formed in the side rails 42, 44 abutting the longitudinal side walls 48 within the channels 50, thereby substantially preventing lateral movement of the support pedestals 18, 20 relative to the table top 12. Likewise, the cross brace member 36 may be positioned within opposing respective retaining apertures 46 formed in the side rails 42, 44 abutting the longitudinal side walls 48 within the channels 50, thereby substantially preventing lateral movement of the cross brace member 36 relative to the table top 12. The support pedestals 18, 20 and the cross brace member 36 are preferably disposed substantially parallel to each other and in spaced-apart relationship.

Still referring to FIG. 2, the frame 40 may also comprise a first end rail 54 and an opposing second end rail 56. Preferably, the first end rail 54 is disposed substantially parallel the opposing end rail 56. Each end rail 54, 56 has a first end 58 and a second end 60 and is preferably positioned along the opposing orthogonal interior side walls 52 of the mounting surface 14 of the table top 12. In one presently preferred embodiment, the first end 58 of each end rail is disposed within the channel 50 adjacent respective ends 62*a*, 62*b* of the first side rail 42. Likewise, the second end 60 of each end rail 54, 56 is disposed within a channel 50 adjacent respective ends 64*a*, 64*b* of the second side rail 44, thereby providing a generally rectangular shape to substantially correspond with the generally preferable rectangular shape of the table top 12.

In one presently preferred embodiment of the present invention, the first and second ends 58, 60 of respective end rails 54, 56 are configured with a tab member 66. The tab member 66 may be configured to fit within respective channels 50 beneath the retaining aperatures 46 near the ends 62, 64 of the respective side rails 42, 44 with the utility table 10 in an upright position. It will be readily appreciated by those skilled in the art that, in this configuration, the tab members 66 act as levers with the support pedestals 18, 20 (positioned within the channels 50 near the ends 62, 64 of the respective side rails 42, 44), thus, acting as corresponding fulcrums. In this manner, the end rails 54, 56 strengthen respective ends 68*a*, 68*b* of the table top 12, and protect against bowing of the table top 12 at the ends 68*a*, 68*b*. The first and second side rails, 42, 44, in combination with the first and second end rails 54, 56 provide a means for structurally supporting the table top 12, support pedestals 18, 20, and pivotal support braces 24, 30. In this configuration, lighter weight table tops 12 may be used without losing rigidity or structural integrity.

As will be appreciated, the end rails 54, 56 may interrelate to the side rails 42, 44 in a variety of ways to provide structural support for the utility table 10 and help protect against bowing under various loads that may be applied to the utility table 10. For example, the end rails 54, 56 may be welded to the side rails 42, 44. The end rails 54, 56 may also be bonded to the side rails 42, 44 using a variety of suitable epoxies or resins. Further, the end rails 54, 56 and the side rails 42, 44 may be formed as a single unitary piece configured to the desired size and shape. It will also be appreciated that the end rails 54, 56 and the side rails 42, 44 need not interrelate at all, but could simply be attached to the respective interior opposing side walls 48, 52 of the mounting surface 14 of the table top 12.

In one presently preferred embodiment of the present invention, the frame 40 is formed of a substantially sturdy, rigid material sufficient to provide structural integrity to the table top 12. For example, the frame 40 may be formed of metal. However, it will be readily appreciated that the frame may be formed of a wide variety of other suitable materials which are consistent with the spirit and scope of the present invention. It will further be appreciated that size and configuration of the frame 40 will depend, in part, on the size and configuration of the table top 12. The table top 12 and the frame 40 may be configured in a variety of configurations, including, but not limited to, a circle, polygon, square, triangle or any other suitable geometrical configuration.

Figure 3:
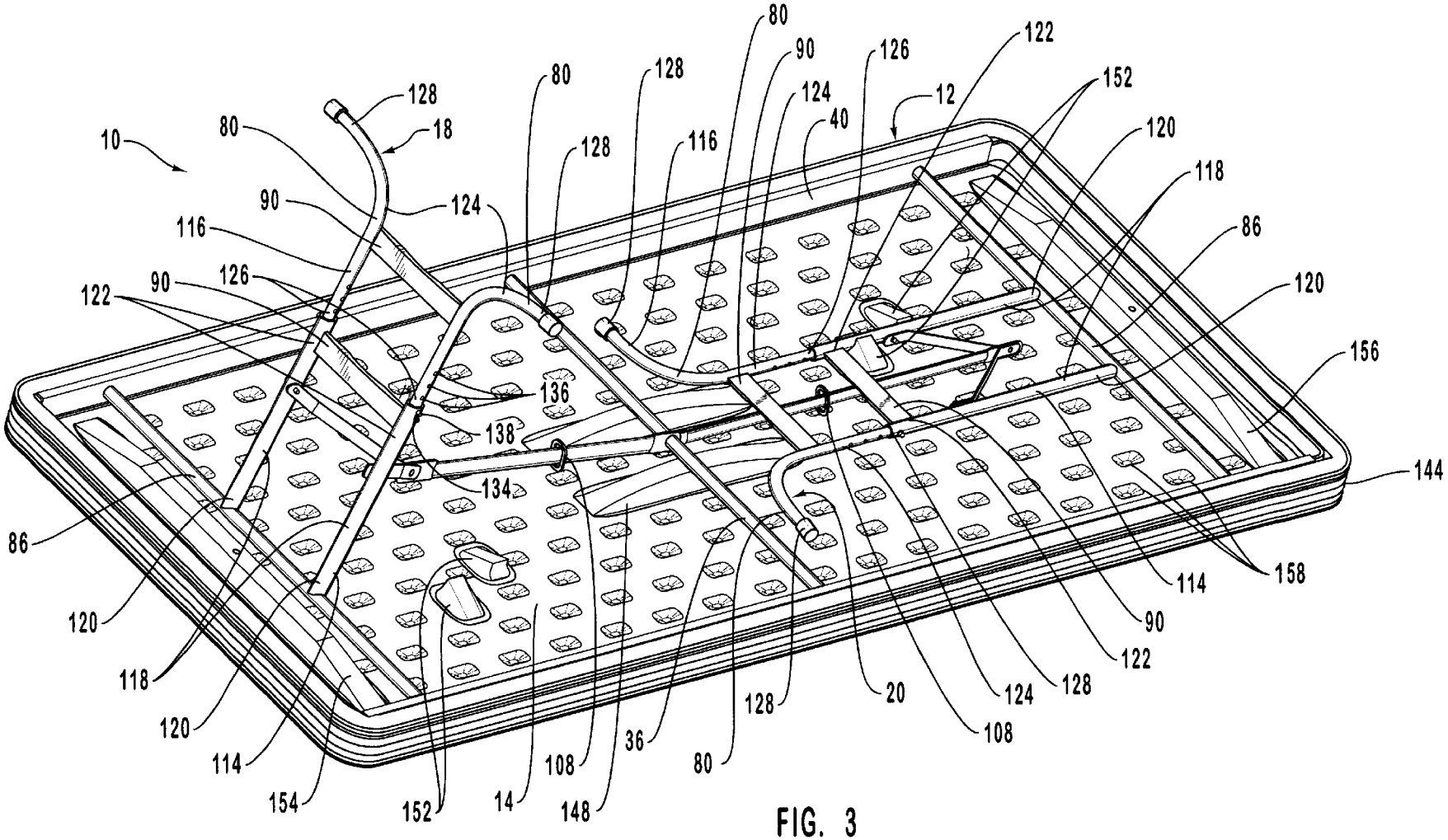
FIG. 3 is a perspective view of the embodiment of FIG. 1 illustrates a retaining assembly and support pedestals in relation to a mounting surface of the table top.

As best shown in FIG. 3, the shaped size of the frame 40 is configured to generally conform to the internal periphery of the mounting surface 14 of the table top 12. Specifically, in one presently preferred embodiment of the present invention, the frame 40 is attached in relation to the mounting surface 14 by means of fasteners (not shown) which generally penetrate both the frame 40 and an adjacent point of the mounting surface 14. As will be appreciated by those skilled in the art, a variety of other suitable means for attaching the frame 40 to the mounting surface 14 of the table top 12 may be employed, including, but not limited to, rivets, screws, bolts, glues, epoxies, or other bonding materials.

As can be seen in FIGS. 2 and 3, the mounting surface 14 of the table top 12 is preferably configured to facilitate the attachment of the frame 40 to the mounting surface of the table top 12. In one presently preferred embodiment, the mounting surface 14 is configured with seats (not shown) positioned such that the end rails 54, 56 may be positioned between respective opposing orthogonal interior walls 52 and the seats (not shown). In this configuration, the end rails 54, 56 are substantially prevented from bowing inwardly toward the center of the utility table 10 under loads exerted upon the opposing ends of the table top 12.

It will be readily appreciated that the mounting surface 14 need not have interior side walls 48, 52 at all to practice the teachings of the present invention. In this regard, the teachings of the present invention may be practiced without a frame 40 if the table top 12 is sufficiently rigid (see FIG. 4). It will further be appreciated by those skilled in the art that in the embodiments where there is no frame, the support pedestals 18, 20 and cross brace member 36, may be attached to an interior portion 70 of the mounting surface 14. Further, in preferred embodiments where there are interior side walls 48, 52, but no frame 40, the support pedestals 18, 20 and cross brace member 36 may be positioned directly in retaining (not shown) formed within the interior side walls 48, 52 of the mounting structure 14 of the table top 12.

Referring again to FIG. 2, the support pedestals 18, 20 are pivotally attached to the mounting surface 14, thereby permitting each of the support pedestals 18, 20 to be moved between a collapsed position, in which each support pedestal 18, 20 lies flat in substantially the same plane as the table top 12, and an extended position, in which each support pedestal 18, 20 is folded outward, substantially perpendicular to the plane of the table top 12.

Each support pedestal 18, 20 may include a pair of substantially parallel posts 80. Those of skill in the art will appreciate that the teachings of the present invention can be practiced if each support pedestal 18, 20 has more or less than two posts 80. Each pair of posts 80 comprises a first end 82 and a second end 84. In one presently preferred embodiment, the first end 82 of each respective pair of posts 80 is secured to a cross pole 86.

Respective ends 88 of each cross pole 86 are preferably positioned within opposing retaining apertures 46 disposed within the opposing side rails 42, 44 of the frame 40 such that the support pedestals 18, 20 may be disposed substantially parallel to each other. In this configuration, each cross pole 86 rotates within respective pairs of retaining apertures 46 when respective pedestals 18, 20 move between the collapsed position and the extended position. In one presently preferred embodiment, a stabilizer arm 90 is preferably disposed between the respective pairs of posts 80 to assist in maintaining the spaced-apart relationship of the posts 80.

It will be appreciated by those skilled in the art that the support pedestals 18, 20 may be configured in a variety of ways such that to practice the teachings ofthe present invention. For example, the support pedestals 18, 20 may comprise a solid or integral piece or the posts 80 may be curved in a different manner (e.g., see, FIG. 3). It will further be appreciated by those of skill in the art that the support pedestals 18, 20 need not be in pivotal engagement with the table top 12 to be collapsible. For example, the support pedestals 18, 20 may simply be detachably engaged in relation to the table top 12 such that when it is desired to collapse the utility table 10 for storage, the support pedestals 18, 20 are removed from engagement with the table top 12.

As stated above, the first and second support pedestals 18, 20 are preferably connected to the table top 12 by methods of the first and second pivotal support braces 24, 30, respectively. In one presently preferred embodiment of the present invention, the proximal ends 26, 32 of the respective pivotal support braces 24, 30 are bifurcated to facilitate pivotal engagement with the posts 80 of the respective support pedestals 18, 20 as illustrated in FIGS. 1, 2, and 3. The bifurcated proximal ends of the pivotal support braces 24, 30 each preferably comprise a pair of angled members 100.

Referring specifically to FIG. 2, the angled members 100 may include a tab member 102 which pivotally engages and partially overlaps a corresponding tab member 104 adjacent each of the distal ends 28, 34 of the pivotal support braces 24, 30, respectively, at an overlapping portion 106. When the support pedestals 18, 20 are in the extended position, the tabs 102 of the angled members 100 of the bifurcated proximal ends 26, 32 are disposed substantially parallel to the tabs 104 adjacent each distal end 28, 34 of the pivotal support braces 24, 30. When the support pedestals 18, 20 are in the collapsed position, the tabs 102 of the angled members 100 of the bifurcated proximal ends 26, 32 are disposed substantially unparallel to the tabs 104 adjacent each distal end 28, 34 of the pivotal support braces 24, 30.

The utility table 10 may include a pair of locking collars 108 which slidably engage respective pivotal support braces 24, 30. The locking collars 108 are preferably sized to fit over respective overlapping portions 106 of the pivotal support braces 24, 30 when the support pedestals 18,20 are in the extended position. With the locking collars 108 positioned over respective overlapping portions 106, the bifurcated proximal ends 26, 32 are prevented from moving relative to corresponding distal ends 28, 34 of the pivotal support braces 24, 30, thus preventing the support pedestal supports 18, 20 from being positioned in the collapsed position without first disengaging the locking collars 108, respectively.

It will be appreciated by those skilled in the art that with the utility table 10 in an upright position and the support pedestals 18, 20 in the extended position, the collars 108 may, under the force of gravity, position themselves about the overlapping portions 106. It will further be appreciated that a variety of other locking mechanisms as assemblies may be utilized to lock the support pedestals 18, 20 in the extended position which are consistent with the spirit and scope of the present invention, including latches or other fasteners.

With reference now to FIG. 3, the utility table 10 is shown having an alternative configuration of the support pedestals 18, 20. In this alternate embodiment, each support pedestal 18, 20 comprises a first member 114 pivotally engaged to the mounting surface 14 of the table top 12 and a second member 116 configured for telescoping engagement with the first member 114, thereby permitting the height of each support pedestal 18, 20 to be selectively disposed at a predetermined height between a lengthened position and a retracted position.

In one presently preferred embodiment, each first member 114 of the support pedestals 18, 20 includes a pair of outer members 118 each having a proximal end 120 and a distal end 122. The proximal end of each outer member 118 is connected to the table top 12 by means of the cross pole 86 to which they are preferably fixed (e.g., welded). The second member 116 of each support pedestal 18, 20 includes a pair of inner members 124 each having a proximal end 126 and a distal end 128. The proximal end 126 of the inner members 124 are configured in dimensional size and shape to engage the distal ends 122 of the outer members 118 in telescopic engagement. It will be appreciated by those of skill in the art that multiple stabilizer arms 90 may be employed to support the telescopic pedestals 18, 20.

Preferably, the inner members 124 and outer members 118 are separated by a hard plastic bushing (not shown) to facilitate the slidable movement of the inner members 124 relative to the outer members 118. Each bushing may be held in place with two small extensions that extend through small holes (not shown) in the outer members 118. It will be appreciated by those of skill in the art that there are a number of ways to facilitate the telescopic movement of the first member 114 relative to the second member 116 of each support pedestal 18, 20.

In the preferred embodiment illustrated in FIG. 3, the support pedestals 18, 20 include means for locking the support pedestals 18, 20 in preselected positions between the retracted position and the lengthened position. At least one of the inner members 124 is configured with a first hole 134. A corresponding outer member 118 may be configured with at least one hole 136 and preferably a plurality of holes 136 positioned such that at a preselected table top 12 height, the first hole 134 in the inner member 124 may be aligned with a second hole 136 in the outer member 118. A snap pin mechanism 138 may be positioned adjacent the first hole 134 within the inner member 124 such that the pin 138 is biased outwardly through the aligned holes 134, 136, thereby locking the inner and outer members 118, 124 of the support pedestals 18,20 in an preselected position. By supplying sufficient force to the pin mechanism 138, it may be removed from the hole 136 in the outer member 118, thereby permitting relative movement between the inner 124 and outer 118 members of the support pedestals 18, 20 and allowing the support pedestals 18, 20 to be selectively raised or lowered. It will be appreciated by those skilled in the art that a variety of other adjustment mechanisms as assemblies known in the art for locking the first and second support pedestals 18, 20 in an extended position may be utilized and are herein incorporated.

As best shown in FIGS. 1, 2, and 3, the distal ends 28, 34 of each pivotal support brace 24, 30 are engageably secured to the retaining assembly 36 (e.g., cross brace member). In one presently preferred embodiment of the present invention, the distal ends 28, 34 of each pivotal support brace 24, 30, respectively, are pivotally attached to the retaining assembly 36. Each of said distal ends 28, 34 are configured with openings 142 having an interior periphery sufficient for engaging at least a portion of the linear length of the cross-brace member 36.

It will be appreciated by those skilled in the art that the retaining assembly generally provides structural support to the center of the table top 12 of the utility table 10. It will further be appreciated that with the distal ends 28, 34 attached contiguous each other in retention to the cross brace member 36, forces applied to the table top 12 which would ordinarily be transferred through one of the support pivotal braces 24, 30, respectively into the table top 12 causing it to bow, will substantially be nullified by the counter force provided by the other pivotal support brace 24, 30, respectively.

For example, the horizontal component of a force applied by a user at one end 68*a* of the table top 12 will act upon the pivotal support brace 18 and, because the distal ends 28, 34 of the pivotal support braces 24, 30, respectively, are attached to the retaining assembly 36, an equal and opposite horizontal force component applied by the other pivotal support brace 20 will substantially cancel out the horizontal component of the original force. Accordingly, the present invention provides increased support with fewer parts. As will be appreciated by those skilled in the art, the retaining assembly 36 can be disposed in a variety of configurations which are consistent with the spirit and scope of the present invention so as to allow the pivotal support braces 24, 30 to supportably interrelate with each other. One such alternative configuration is discussed below.

With reference to FIGS. 1, 2 and 3, the table top 12 is preferably formed of a blow-molded plastic, and specifically, high density polyethylene. It will be appreciated by those of skill in the art, however, that the table top 12 may be formed of a variety of other sufficiently sturdy materials such as, plywood, particle board, solid wood, wood slates, metal alloys, fiberglass, ceramics, graphite, any of numerous organic, synthetic or processed materials, including thermoplastic or thermosetting polymers of high molecular weight with or without additives, such as, plasticisers, auto oxidants, extenders, colorants, ultraviolet light stabilizers, or fillers and/or other composite materials.

Referring back to FIG. 1, in one presently preferred embodiment of the present invention, the working surface 16 of the table top 12 may be textured. In addition, the working surface 16 may comprise an outer periphery 144 having at least a portion 146 which is beveled to increase the comfort of a person resting their arms against the edges of the table top 12. In one presently preferred embodiment, the entire outer periphery 144 of the working surface 16 of the table top 12 is beveled. The height of the blow-molded table top 12 of the preferred embodiment is about five centimeters, the thickness of any panel 13 of the blow-molded table top 12 is preferably about one-half of a centimeter and about three-quarters of a centimeter.

Referring now to FIGS. 2 and 3, the mounting surface 14 may include at least one mount 148. Preferably, a pair of mounts 148 are attached to the mounting surface 14 to receive and retain the cross brace member 36 of the retaining assembly. Each mount 148 includes a groove 150 configured as a corresponding size and shape sufficient to the cross brace member 36 therein. In one presently preferred embodiment, the cross brace member 36 may be snap fit into the groove 150 of the mount 148.

Additionally, the mounting surface 14 of the table top 12 may further include a securing member 152 for securing each of the support pedestals 18, 20, respectively. Preferably, a pair of securing members 152 are disposed in relation to the mounting surface 14 for releasably securing a respective support pedestal 18, 20 in the collapsed position adjacent the mounting surface 14. Each securing member 152 is generally configured and disposed relative to the mounting surface 14 such that when the support pedestals 18, 20 are in the collapsed position, the least one securing member 152 frictionally engages a support pedestal post 80 such that the support pedestals 18, 20, respectively, are maintained in the collapsed position, as illustrated in FIG. 3. In one presently preferred embodiment, a pair of securing member 152 are offset on opposing sides of a single support pedestal post 80 for securing each of the support pedestals 18, 20, respectively, in the collapsed position.

As best shown in FIGS. 2 and 3, a first manifold 154 and a second manifold 156 are preferably disposed at opposing ends 68*a*, 68*b* of the table top 12. The manifolds 154, 156 provide additional support for the ends 68*a*, 68*b* of the table top 12 and assist in facilitating the blow molding process by providing a means for uniformly dispersing air down the length of the table top 12. The mounting surface 14 of the table top 12 may also include a plurality of depressions 158 (e.g., kiss-offs) which add structural support to the table top 12. In one presently preferred embodiment, these depressions 158 are uniformly distributed throughout the mounting surface 14 of the table top 12.

The structural features of the table top 12, including the beveled and/or textured working surface 16, the mounts 148, the securing members 152, the manifolds 154, 156, and the depressions 158 may be integral with the table top 12 and one preferably created by means of a corresponding mold and blow-molding process. It will be appreciated by those skilled in the art that there are alternative ways to create and attach these features. For example, the mounts 148 securing members 152 and manifolds 154, 156 may be separate pieces attached to the mounting surface by adhesive bonding or the use of fasteners. Likewise, the texturing and/or beveling of the working surface and the introduction of depressions into the mounting surface may also be accomplished after the table top 12 is molded by a variety of conventional methods readily known in the art.

Figure 4:
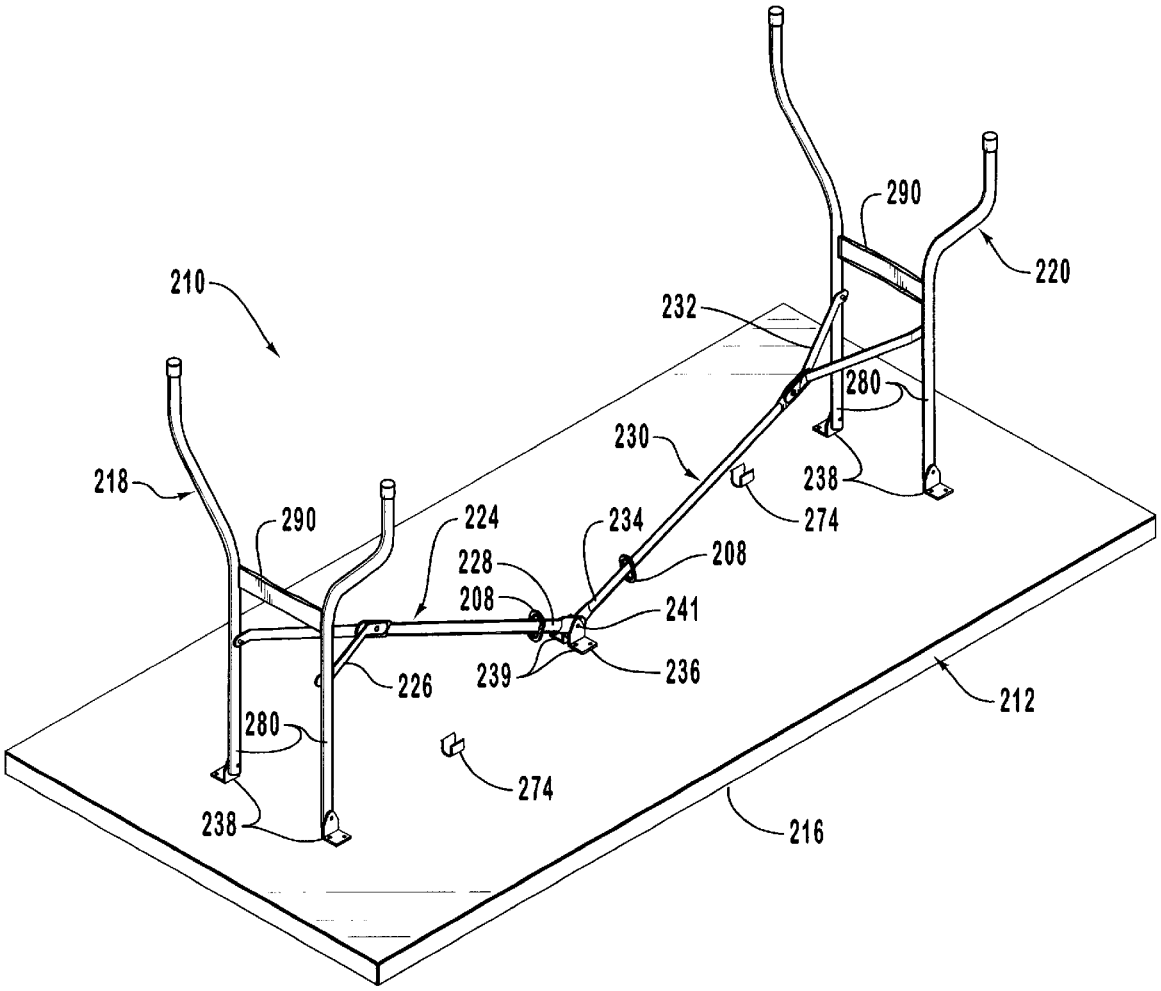
FIG. 4 is a perspective view of yet another presently preferred embodiment of the portable folding utility table with center support assembly.

With reference now to FIG. 4, another presently preferred embodiment of the utility table of the present invention is generally designated at 210. In this embodiment, the utility table 210 includes a table top 212 having a mounting surface 214 and a working surface 216 disposed opposite the mounting surface 214. A first support pedestal 218 and a second support pedestal 220 are pivotally attached to the mounting surface 214 of the table top 212 by means of a respective pairs of brackets 222. Each support pedestal 218, 220 may include a pair of substantially parallel posts 280 each having a first end 282 secured to one of the mounting brackets 238. In this configuration, the support pedestals 218, 220 may be moved between a collapsed position, in which each support pedestal 218, 220 lies flat in substantially the same plane as the table top 212 and an extended position, in which each support pedestal 218, 220 is folded outward substantially perpendicular to the plane of the table top 212.

Preferably, the utility table 210 includes a first pivotal support brace 224 having a bifurcated proximal end 226 attached to the first support pedestal 218 and a distal end 228 attached to the mounting surface 214. Similarly, a second pivotal support brace 230 having a bifurcated proximal end 232 attached to the second support pedestal 220 and a distal end 234 attached to the mounting surface 214. Each of said distal ends 228, 234 of the pivotal support braces 224, 230 are configured with openings 242 (not shown).

As with the utility table 10 of the embodiments illustrated in FIGS. 1–3, the embodiment of FIG. 4 may include a pair of locking collars 108 which slidably engage respective pivotal support braces 224, 230. The locking collars 108 are preferably sized to such that when the support pedestals 218, 220 are in the extended position, the locking collars 108 can be positioned to prevent the bifurcated proximal ends 226, 232 are prevented from moving relative to corresponding distal ends 228, 234 of the pivotal support braces 224, 230, thus preventing the support pedestal supports 218, 220 from being positioned in the collapsed position without first disengaging the locking collars 108, respectively.

In one presently preferred alternate embodiment, a retaining assembly 236 comprises a pair of L-shaped brackets 239, each of which includes an opening (not shown). The distal ends 228, 234 of each pivotal support brace 224, 230, respectively, are pivotally attached to the retaining assembly 236 by means of a pivot pin 241. It will be appreciated by those skilled in the art that there are a number of ways to secure the distal ends 228, 234 of the pivotal support braces 224, 230, respectively contiguous to each other in supportable relation to the mounting surface 214 of the table top 212. These may include a variety of brackets, or plates to which the distal ends 228, 234 of the pivotal support braces 224, 230, respectively, are attached by fasteners, including, but not limited to, a cotter pin, bolt, rivet, clamp or the like.

The table top 212 of the embodiment illustrated in FIG. 4 may be formed of a variety of sufficiently sturdy materials such as, plywood, particle board, solid wood, wood slates, metal alloys, fiberglass, ceramics, graphite, any of numerous organic, synthetic or processed materials, including high density polyethylene thermoplastic or thermosetting polymers of high molecular weight with or without additives, such as, plasticisers, auto oxidants, extenders, colorants, ultraviolet light stabilizers, or fillers and/or other composite materials. It will also be appreciated by those with skill in the art that telescoping pedestals discussed previously may also be used with this embodiment.

As illustrated in FIG. 1, with the utility table 10 is in an upright position and the support pedestals 18, 20 extended with the collars 108 placed over the overlapping portions 106 of respective pivotal support braces 24, 30, the utility table of the present invention is disposed for use. When a user desires to collapse the table for storage, one preferred method is to invert the utility table 10 as illustrated in FIG. 3. With the utility table 10 in the inverted position, the collars 108 may be slid away from the overlapping portion 106 of respective pivotal support braces 24, 30. This allows the support pedestals 18, 20 to be folded inwardly toward the table top 12 into the collapsed position. With the support pedestals 18, 20 in the collapsed position, the utility table 10 can easily be moved and stored.

Many of the problems associated with prior art portable folding utility tables are addressed by the teachings of the present invention. From the above discussion, it will be appreciated that the present invention provides a novel portable folding utility table having a center support assembly that is durable enough to withstand increased wear and tear, yet is light-weight enough to easily set up and take down. The present invention also provides a utility table with a center support retaining assembly that provides increased stability and structural integrity with an efficient design that allows the interrelation of the support pedestals to each other. The center support retaining assembly of the utility table of the present invention is also cost effective to manufacture and does not compromise the structural integrity of the table top. The present invention also provides a portable folding utility table that includes a workers surface that is comfortable to work at.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A utility table, comprising:

a frame comprising opposing sides;

a table top disposed in relation to said frame, said table top having a mounting surface and a working surface disposed opposite the mounting surface;

a pair of support pedestals, each support pedestal having a first end attached to said frame;

a retention member engaging said opposing sides of said frame;

a first pivotal support brace having a proximal end attached to the first support pedestal and a distal end engaging said retention member;

a second pivotal support brace having a proximal end attached to the second support pedestal and a distal end engaging said retention member; and the distal end of the first pivotal support brace being attached to the distal end of the second pivotal support brace by means of said retention member.

2. The utility table as defined in claim 1, wherein the distal end of each pivotal support brace is pivotally attached to the retention member.

3. The utility table as defined in claim 1, wherein the distal end of each of the pivotal support braces comprises an opening having an interior periphery sufficient for engaging said retention member.

4. The utility table as defined in claim 1, wherein the support pedestals are pivotally attached to the mounting surface, thereby permitting each of the support pedestals to be moved between a collapsed position and an extended position.

5. The utility table as defined in claim 4, further comprising at least one securing member disposed in relation to the mounting surface for releasably securing the support pedestal in the collapsed position.

6. The utility table as defined in claim 1, wherein the working surface of the table top is textured.

7. The utility table as defined in claim 1, wherein the working surface of the table top comprises an outer periphery, the outer periphery having at least a portion being beveled.

8. The utility table as defined in claim 1, wherein the table top is formed of plastic.

9. A utility table, comprising:

a frame comprising opposing side rails;

a table top disposed in relation to said rigid frame said table top having a mounting surface and a working surface disposed opposite the mounting surface;

a pair of support pedestals, each support pedestal having a first end attached to the mounting surface of the table top, thereby permitting each of the support pedestals to be moved between a collapsed and an extended position;

a retention member engaging said opposing side rails of said frame;

a first pivotal support brace having a proximal end attached to the first support pedestal and a distal end pivotally attached to the mounting surface;

a second pivotal support brace having a proximal end attached to the second support pedestal and a distal end pivotally attached to the mounting surface; and the distal end of the first pivotal support brace and the distal end of the second pivotal support brace engagably secured to each other by means of said retention member.

10. The utility table as defined in claim 9, further comprising at least one securing member disposed in relation to the mounting surface for releasably securing the support pedestal in the collapsed position.

11. The utility table as defined in claim 9, further comprising at least one mount disposed in relation to the mounting surface, the mount configured to receive and retain the retention member.

12. The utility table as defined in claim 9, wherein the distal end of each of the pivotal support braces comprises an opening having an interior periphery sufficient for engaging said retention member.

13. The utility table as defined in claim 9, wherein the working surface is textured.

14. The utility table as defined in claim 9, wherein the frame further comprises opposing end rails.

15. The utility table as defined in claim 9, wherein each support pedestal comprises a first member pivotally engaged to the mounting surface of the table top and a second extension member configured for telescoping engagement with the first member, thereby permitting the height of the support pedestal to be disposed between a lengthened position and a retracted position.

16. The utility table as defined in claim 9, wherein the table top is formed of plastic.

17. The utility table as defined in claim 9, wherein the mounting surface of the table top comprises a plurality of depressions for structural support.

18. The utility table as defined in claim 9, wherein the working surface of the table top comprises an outer periphery, the outer periphery having at least a portion being beveled.

19. The utility table as defined in claim 9, wherein the proximal ends of the braces are bifurcated to facilitate engagement with the respective support pedestal.

20. A utility table, comprising:

a rigid frame comprising opposing side rails;

a unitary table top disposed in relation to said rigid frame, said table top having a mounting surface and a working surface disposed opposite the mounting surface;

a pair of support pedestals, each of said support pedestals having a first end pivotally attached to said rigid frame, wherein said support pedestals are movable between a collapsed position and an extended position;

a cross brace member engaging said opposing side rails of said frame;

a first pivotal support brace having a proximal end attached to the first support pedestal and a distal end adapted to be pivotally attached to said rigid frame;

a second pivotal support brace having a proximal end attached to the second support pedestal and a distal end adapted to be pivotally attached to said rigid frame; and the distal end of the first pivotal support brace attached at the distal end of the second pivotal support brace.

21. The utility table as defined in claim 20, wherein said distal end of each of said pivotal support braces are pivotally attached to said cross brace member.

22. The utility table as defined in claim 20, wherein said distal end of each of said pivotal support braces comprises an opening having an interior periphery sufficient for engaging said cross brace member.

23. The utility table as defined in claim 20, wherein said rigid frame comprises at least one retaining aperture adapted to engage said cross brace member.

24. The utility table as defined in claim 20, wherein said rigid frame further comprises opposing end rails.

25. The utility table as defined in claim 20, wherein each of said opposing side rails comprises at least one retaining aperture adapted to engage a first support pedestal in pivotal engagement.

26. The utility table as defined in claim 25, wherein said first support pedestal comprises a cross pole member operably disposed between corresponding retaining apertures formed in said opposing side rails.

27. The utility table as defined in claim 20, wherein each of said opposing side rails comprises at least one retaining aperture adapted to engage a second support pedestal in pivotal engagement.

28. The utility table as defined in claim 27, wherein said second support pedestal comprises a cross pole member operably disposed between corresponding retaining apertures formed in said opposing side rails.

29. The utility table as defined in claim 20, further comprising a securing member disposed in relation to said mounting surface for releaseably securing said support pedestals in said collapsed position.

30. A utility table, comprising:

a rigid frame comprising opposing side rails;

a table top disposed in relation to said rigid frame, said table top having a mounting surface and a working surface disposed opposite the mounting surface;

a retention member engaging said opposing side rails of said frame;

a first support pedestal pivotally attached to said rigid frame;

a second support pedestal pivotally attached to said rigid frame at a spaced apart distance from said first support pedestal; and said first and second support pedestals being movable between a collapsed position and an extended position.

31. The utility table as defined in claim 30, further comprising a pivotal support brace having a proximal end attached to said first support pedestal and a distal end adapted to be pivotally attached to said retention member.

32. The utility table as defined in claim 31, wherein said distal end of said pivotal support brace comprises an opening having an interior periphery sufficient for engaging said retention member.

33. The utility table as defined in claim 30, further comprising a pivotal support brace having a proximal end attached to said second support pedestal and a distal end adapted to be pivotally attached to said retention member.

34. The utility table as defined in claim 33, wherein said distal end of said pivotal support brace comprises an opening having an interior periphery sufficient for engaging said retention member.

35. The utility table as defined in claim 30, wherein said rigid frame comprises opposing end rails.

36. The utility table as defined in claim 35, wherein each of said opposing side rails comprises at least one retaining aperture adapted to engage said second support pedestal in pivotal engagement.

37. The utility table as defined in claim 36, wherein said second support pedestal comprises a cross pole member operably disposed between corresponding retaining apertures formed in said opposing side rails.

38. The utility table as defined in claim 30, wherein each of said opposing side rails comprises at least one retaining aperture adapted to engage said first support pedestal in pivotal engagement.

39. The utility table as defined in claim 38, wherein said first support pedestal comprises a cross pole member operably disposed between corresponding retaining apertures formed in said opposing sid e rails.

40. The utility table as defined in claim 30, further comprising a securing member disposed in relation to said mounting surface for releasably securing said support pedestal in said collapsed position.

41. The utility table as defined in claim 30, wherein said table top is formed of plastic.

42. The utility table as defined in claim 30, wherein said mounting surface of said table top comprises a plurality of depressions for structural support.

43. The utility table as defined in claim 30, wherein said working surface of said table top comprises an outer periphery, said outer periphery having at least a portion being beveled.

44. The utility table as defined in claim 1, wherein the table top is unitary.

45. The utility table as defined in claim 9, wherein the table top is unitary.

* * * * *

UNITED STATES PATENT AND TRADEMARK OFFICE

CERTIFICATE OF CORRECTION

PATENT NO. : 6,112,674
APPLICATION NO. : 09/228326
DATED : September 5, 2000
INVENTOR(S) : Carl R. Stanford It is certified that error appears in the above-identified patent and that said Letters Patent is hereby corrected as shown below:

Column 1
Lines 9-12, remove “, and our patent application Ser. No. Des. 419,332 and entitled UTILITY TABLE, which is also incorporated herein by reference”

Column 2
Line 45, change “us” to --is--

Column 3
Line 4, after “thereof” insert --.--
Line 6, after “thereof” insert --.--
Line 14, change “of the” to --of the--
Line 38, change “such that to” to --such as to--
Line 66, change “illustrates” to --illustrating--

Column 4
Line 31, change “comprise” to --comprises--

Column 7
Line 5, change “of the” to --of the--

Column 10
Line 7, change “member” to --members--

Column 11
Line 2, after “sized” remove “to”
Line 43, change “portion” to --portions--

Column 12
Line 58, after “rigid frame” insert --,--

UNITED STATES PATENT AND TRADEMARK OFFICE

CERTIFICATE OF CORRECTION

PATENT NO. : 6,112,674
APPLICATION NO. : 09/228326
DATED : September 5, 2000
INVENTOR(S) : Carl R. Stanford It is certified that error appears in the above-identified patent and that said Letters Patent is hereby corrected as shown below:

Column 15
Line 10, change “sid e” to --side--

Signed and Sealed this

Twenty-third Day of October, 2007

JON W. DUDAS
*Director of the United States Patent and Trademark Office*